US005184942A

United States Patent [19]

Deininger et al.

[11] Patent Number: 5,184,942

[45] Date of Patent: Feb. 9, 1993

[54] STORAGE CONTAINER WITH AN ELECTRICALLY OPERABLE CIRCULATING PUMP

[75] Inventors: Anton Deininger, Bachhagel; Karlheinz Farber, Giengen; Heinz-Werner Giefer, Sontheim; Egon Galler-Benker, Offingen, all of Fed. Rep. of Germany

[73] Assignees: The Coca Cola Company, Atlanta, Ga.; Bosch-Siemens Hausgerate GmbH, Munich, Fed. Rep. of Germany

[21] Appl. No.: 729,197

[22] Filed: Jul. 12, 1991

[30] Foreign Application Priority Data

Aug. 16, 1990 [DE] Fed. Rep. of Germany ..... 4025986

[51] Int. Cl.[5] ..... F04B 17/00; F04B 35/04

[52] U.S. Cl. ..... 417/360; 417/423.7; 261/36.1; 261/DIG. 7

[58] Field of Search ..... 417/360, 423.3, 423.7, 417/423.15, 423.11, 424.1; 261/151, 36.1, DIG. 7; 222/146.6, 129.1, 185

[56] References Cited

U.S. PATENT DOCUMENTS

| | | | |
|---|---|---|---|
| 4,247,265 | 1/1981 | Cavaleante | 417/423.7 |
| 4,530,803 | 7/1985 | Kuekens | 261/36.1 |
| 4,635,824 | 1/1987 | Gaunt et al. | 222/129.1 |

*Primary Examiner*—Richard A. Bertsch
*Assistant Examiner*—Alfred Basichas
*Attorney, Agent, or Firm*—Birch, Stewart, Kolasch & Birch

[57] ABSTRACT

A carbonator tank in a post-mix beverage dispenser is provided with an electrically powered circulating pump. The pump is mounted in an opening in the bottom of the tank and includes a flow-through channel for dispensing carbonated liquid from the tank through the housing of the pump. The tank includes a cooling coil for forming an ice bank around the interior walls. The heat generated by the pump motor precludes the freezing of the carbonated water in the flow-through channel.

7 Claims, 2 Drawing Sheets

STORAGE CONTAINER WITH AN ELECTRICALLY OPERABLE CIRCULATING PUMP

BACKGROUND OF THE INVENTION

The present invention relates to a storage container with an electrically operable circulating pump, in particular a storage container for beverage-vending machines for the storing, carbonation and cooling of water which can be discharged through a drain opening located in the base of the container.

A conventional layout of a circulating pump in the carbonating unit of a beverage-vending machine is known where cooled and pressurized soda-water blended from $CO_2$ gas and fresh water is stored in the carbonating unit acting as a storage container and is available for withdrawal through an outflow connection. Here the outlet opening is fitted centrally in the base of the storage container with the circulating pump located immediately above the outlet opening.

As a further precaution the circulating pump is affixed to a flow-through unit for the soda-water outlet from the storage container.

Such a layout is employed in conjunction with beverage-vending machines to store the cooled and pressurized water enriched with $CO_2$ gas in order to blend it in the desired proportion with separately introduced beverage concentrates into a useable beverage.

In order to ensure a sufficient carbonation of the fresh water in the storage container, the carbonation procedures in the storage container must be undertaken at increased pressure and backed up by conventional procedures for enriching the liquids with $CO_2$ gas. This can be achieved through a circulating pump that draws $CO_2$ gas from the upper region of the storage container and blends it into the water. Conventionally such kinds of storage containers are also so cooled in their wall regions that an ice layer forms in these regions. This ice layer serves as a coolant capacitor. In order that this ice layer should form at the walls with an approximately uniform thickness, it is useful, if not necessary, to have the water rotate in a circular direction. This task is also conventionally allotted to appropriately equipped and located circulating pumps.

For carbonating and circulating the water a suitable motor must be placed and affixed in the storage container in which an appropriate means of fastening must be provided.

A drain opening for the desired output of carbonated water must also be provided in the vicinity. So as to prevent deterioration in the performance of such a layout owing to icing of the drain opening, these drain openings are conventionally located below the pump motor. The connectors for the motor power supply, however, must also be led out of the storage container in the same vicinity.

SUMMARY OF THE INVENTION

A primary object of the present invention is directed to the creation of a storage container with an electrically operable circulating pump so constructed that its cost of manufacture is reduced as far as possible while ensuring highly reliable operation.

A storage container with an electrically operable circulating pump suited to fulfill this task is according to the invention specially characterized in that a flow-through channel for the water to be dispensed is integrated in the housing of a circulating pump in the base of the storage container, the housing being led through and affixed to the wall.

Integrating the flow-through channel for the water to be dispensed in the housing of the circulating pump on the one hand presents the risk of icing of this channel and on the other eliminates the need for another opening in the storage container. The risk of icing is safely eliminated thereby since the flow-through channel is adequately warmed even by the small amount of heat generated in the pump, especially through rheostatic losses in the pump excitation coil.

The housing of the circulating pump can usually be constructed from plastic, so that the flow-through channel can be readily made using injection technology. The storage container, if for use in a beverage-vending machine as a carbonating unit for the storage of cooled and pressurized water enriched with $CO_2$ gas, is constructed from stainless steel so as to comply with the requirements regarding corrosion and pressure resistance. Any break through its wall is costly in manufacturing terms. Moreover, there is an additional problem with respect to sealing due to an additional channel through the wall.

In a preferred form of construction the arrangement of the storage container and the circulating pump is specially characterized in that the stationary electromagnetic coil of the pump drive motor is located asymmetrically to the side of the latter above a shaft with the rotating armature attached to the pump rotor and that the flow-through channel for the water to be dispensed passes through the pump housing aligned with the rotating armature—pump rotor shaft opposite the excitation coil and in the vicinity of the axial line determined by this shaft.

It is here useful to have the opening for the flow-through channel in the base wall of the storage container located asymmetrically with respect to the container such that the rotating armature—pump rotor shaft is aligned basically with the center of the container. The asymmetrical arrangement of the electromagnetic coil of the drive motor with respect to its drive shaft and the preferred location of the flow-through channel through the pump housing lead to a highly compressed and compact mode of construction for the pump.

At the same time the asymmetrical location of the channel opening in the base wall of the storage container is such that the circulating pump and the latter's shaft is disposed in the center of the container. This is useful because the pump functions to maintain a circular motion of the water stored within the container. This should have the effect that the ice layer formed as a result of cooling in the boundary regions is as cylindrical as possible with respect to its inward-facing wall. Besides its function of maintaining the circular flow of stored water, the pump also draws $CO_2$ gas from the upper part of the container into, and blends it with, the water.

In another preferred construction the circulating pump is specially characterized in that the pump housing is constructed with walls such that a hollow space below and adjoining the exterior of the container is provided for the electromagnetic coil and its armature and is separated by a dividing wall from a hollow space above, in the interior of the container, that is provided for the rotating armature. The wall of the pump housing thereby provides a clean, stable separation between the interior and exterior of the storage container. Only, the flow-through channel penetrates through the wall of the pump housing. Since the space for the electromagnetic coil inside the pump housing is constructed with an opening to the exterior, the electrical connection cables for the electromagnetic coil can also be led out within this open space. The electromagnetic field excited by the electromagnetic coil penetrates the walls to reach the rotating armature, whose location space is open to the interior of the container so that connection to the circulating pump rotor can be achieved without additional sealing problems.

The open space in the pump housing provided for the electromagnetic coil is, after introduction of the latter, preferably filled with casting resin.

A through connection is preferably provided from the flow-through channel in the pump housing to the rotor area. This through connection from the flow-through channel to the rotor area serves in the first place to eliminate any dead space within this rotor area in which gas cavities could collect. It also serves to enable the water to circulate through this rotor area as well, thereby preventing excessive warming there.

In a further preferred construction according to the invention, the arrangement of the storage container with circulating pump is specially characterized in that the pump housing, connected to a mounting flange that serves as an interior mounting on the container wall, is constructed as a support for the flow-through channel through the container wall and also provides an external fastening means to the container wall. Here the external fasting means is preferably affixed to the support for the flow-through channel by means of a bayonet coupling. It will be useful to have the external contours of the pump housing, its flange and its flow-through channel support constructed symmetrically with respect to rotation.

It is useful to have the flow-through channel emerge from the exterior of the pump housing onto a conical support connected to the wall of the pump housing, on which support a connecting piece can be mounted. This connecting piece can be permanently affixed to the conical support by means of the applied casting resin.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF DRAWINGS

The objects of the present invention and the attendant advantages thereof are best illustrated in the accompanying drawings wherein.

DETAILED DESCRIPTION OF PREFERRED EMBODIMENTS

Figure 1:
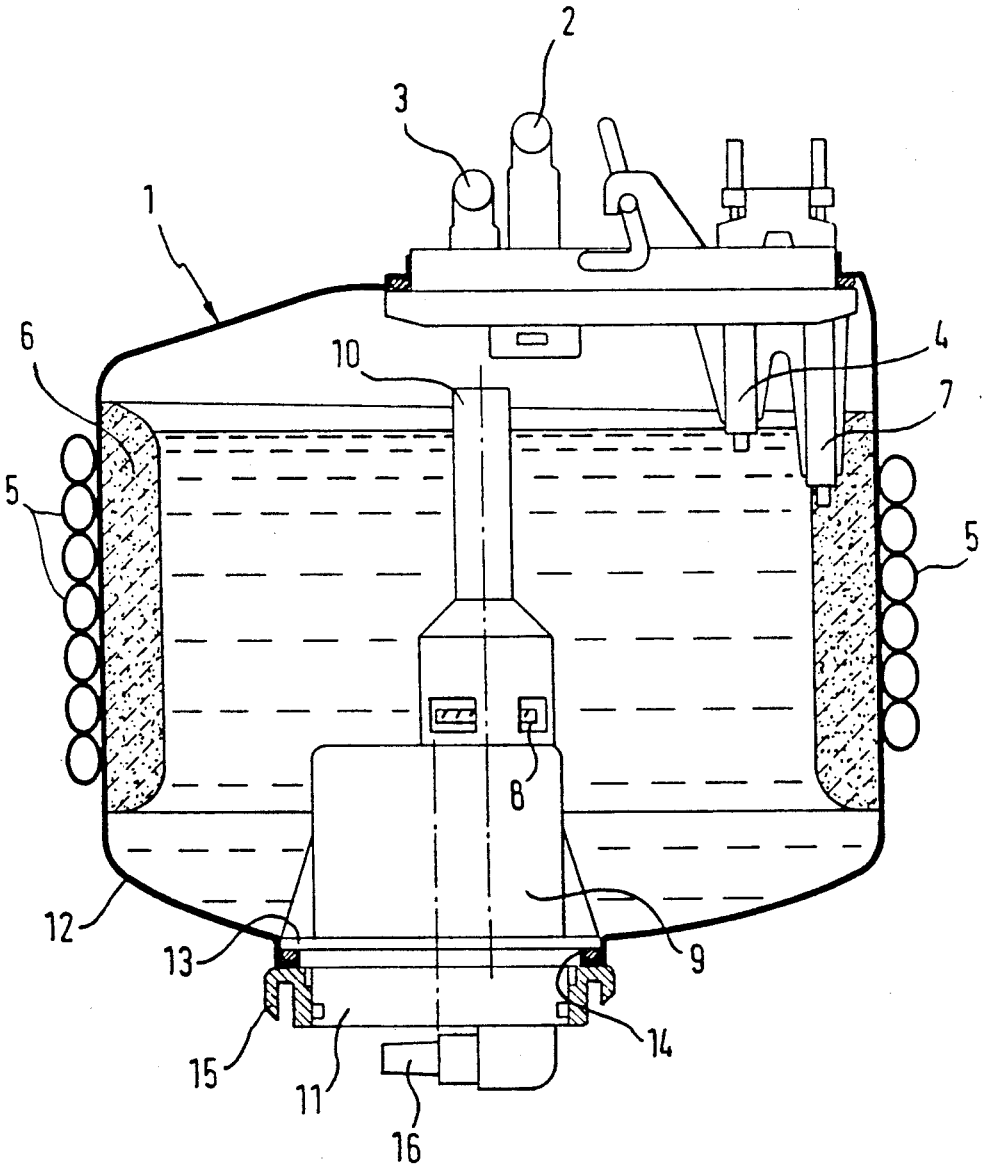
FIG. 1 is a schematic illustration of a carbonator unit with the circulating pump of the present invention mounted therein.

The storage container as in FIG. 1 comprises a carbonator for beverage-vending machines, by means of which carbonated post-mix beverages can be blended from carbonated water, prepared by the carbonator and beverage concentrates, and offered for consumption. The storage container 1 is supplied with water through an inlet 2 and with $CO_2$ gas through an inlet 3. The supply of water and $CO_2$ gas is conventionally provided in response to current demand, where the demand for water is obtainable through a water-level sensor 4 while the gas supply is regulated in accordance with the current internal pressure in the storage container 1. Cooling coils 5 are wrapped externally around the storage container 1 to apply such a level of cooling to it that an ice layer 6 forms around the interior walls of the storage container. The thickness of this ice layer 6 is monitored through a sensor 7, and cooling via the cooling coils 5 is made dependent on the thickness of the layer. Since the blend or solution of water and $CO_2$ gas inside the storage container is liquid and forms an ice layer at the side wall regions, the liquid portion is cooled to the freezing point just under 0° C. The liquid blend inside the storage container is maintained in rotary motion by means of a revolving pump rotor 8, so that the ice layer 6 forms in an internally cylindrical shape. The circulating pump 9 is, therefore, so arranged within the storage container 1 that the pump rotor 8 is disposed with its axle approximately concentric with respect to the storage space formed by the container walls. By means of a tube 10 extending from the pump rotor into the $CO_2$ gas headspace region, this $CO_2$ gas is drawn down by the pump rotor and blended into the liquid. The circulating pump, which is constructed symmetrically with respect to rotation at least in its fastening region, possesses a flow-through unit 11, which extends through the wall 12 of the storage container 1. The circulating pump is supported by a flange 13 on the interior of the wall 12. In the example this wall 12 is drawn outward to some extend in the flow-through region. A seal ring 14 of elastic material is fitted between the flange 13 of the circulating pump 9 and the wall 12 of the storage container 1. By means of a bayonet-type coupling a fastening unit 15 is affixed to the flow-through channel support 11 of the circulating pump 9 outside the pump wall, so that the pump is firmly connected to the storage container 1.

The carbonated water is dispensed through a drain channel 16 leading to an outlet valve that can be constructed in conventional fashion.

Figure 2:
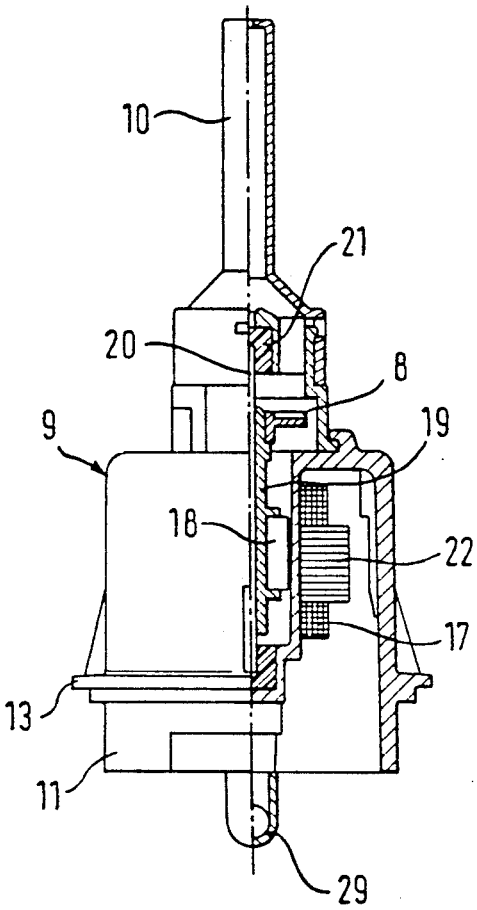
FIG. 2 is a elevational view partly in cross section of the circulating pump viewed from the right side of the pump in FIG. 1.
Figure 3:
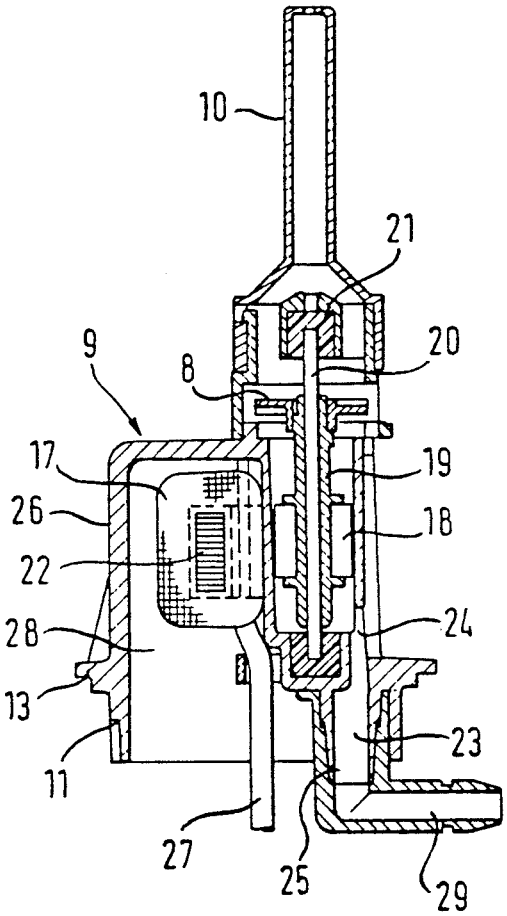
FIG. 3 is a cross-sectional view of the circulating pump viewed from the rear of the pump in FIG. 1.
Figure 4:
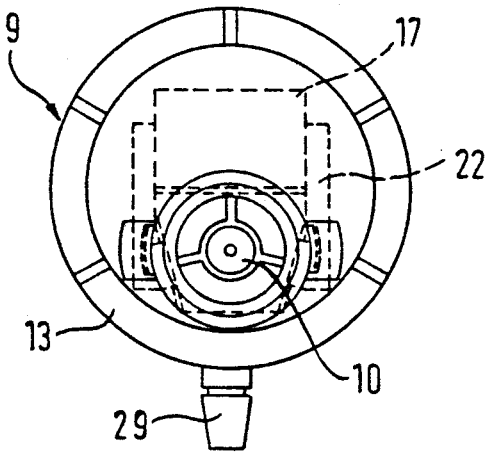
FIG. 4 is a schematic top plan view of the circulating pump viewed from the top of the pump in FIG. 1.

The circulating pump 9 is explained in somewhat greater detail in FIGS. 2 through 4. In FIG. 3 the drain channel direction is reversed with respect to FIG. 1.

The pump rotor 8 is driven by an electromagnetic motor that consists principally of an electromagnetic coil 17 and a rotor 18 made from a permanent magnet. This rotor 18 is connected to the pump rotor 8 via a hollow shaft 19. This hollow shaft 19 rotates around an axle 20 which is mounted vertically on elastic inserts 21 and which preferably and conventionally consists of ceramic material for reasons to do with wearing and bearing technology. As can be seen from FIGS. 3 and 4, the electromagnetic coil 17 is arranged on one side of the rotating armature 18 and the ferromagnetic poles 22 are set laterally in the region of the rotating armature 18. A flow-through channel 23 is integrated in the housing of the circulating pump 9 aligned with the axle of the rotating armature 18 on the side opposite the electromagnetic coil 17. This flow-through channel itself emerges at one end through an opening 24 in the interior of the storage container 1 and at the other in the region of a support 25 and on to the drain channel 16, FIG. 1 (29 FIGS. 2 to 4).

The space for the rotating armature formed by the wall 26 of the pump housing is open on its underside opposite the flow-through channel 23, so that this space can be completely filled by the liquid stored in the storage container 1 and also cooled by the liquid flowing through it.

The wall 26 of the circulating pump 9 is so arranged that it completely separates the space provided for the electro-magnetic coil 17 and the latter's ferromagnetic poles 22 from the pump areas that are open to the interior of the storage container 1. This space provided for the electromagnetic coil 17 is, however, open to the exterior of the storage container 1. The electromagnetic coil 17 can be inserted and the connecting wires 27 led out from this open side. The remaining space around the electromagnetic coil 17 can be filled with casting resin 28. This casting resin also enables permanent adherence of a connecting piece 29 mounted on the external conical support 25 of the flow-through channel 23.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A post-mix beverage dispensing apparatus, comprising:

a storage container including an electrically operable circulating pump for the storing, carbonating and cooling of water which can be dispensed as desired through a drain opening in the base of the storage container, said circulating pump being further comprised of, a drive motor including a stationary electromagnetic coil and a rotating armature, a shaft connected to the rotating armature, and a pump rotor connected to the shaft for rotation therewith, said stationary electromagnetic coil being disposed asymmetrically to one side of a longitudinal axis of the shaft a flow-through channel for the water to be dispensed integrated into a housing of the circulating pump, said housing being mounted through a wall in the base of the storage container;

said flow-through channel being a longitudinal axial channel in liquid communication with said shaft and rotating armature and extending below said shaft through the pump housing to the exterior of the storage container, and means for fastening and sealing the housing in the wall.

2. The apparatus of claim 1, wherein the rotating armature, shaft and pump rotor are aligned with the vertical center axis of the storage container.

3. The apparatus of claim 1 wherein the housing of the circulating pump includes a partition which divides the housing into separate chambers, the electromagnetic coil being in one chamber and the rotating armature, shaft and pump rotor being in another chamber.

4. The apparatus of claim 1, wherein said means for fastening and sealing the pump housing in the wall in the bottom of the container comprises a mounting flange around the pump housing for engaging the inside of said wall at regions surrounding an opening in the wall and a fastener including a bayonet coupling on the outside of the wall, said fastener surrounding the portion of the pump housing extending outside of the container and clamping the pump housing to the container wall against said flange.

5. The apparatus of claim 3 wherein the flow-through channel terminates outboard of the container wall in a tubular extension and a coupling member is provided which fits over said extension, said coupling member being secured with insulating resin filled in the chamber housing said electromagnetic coil.

6. A post-mix beverage dispensing apparatus, comprising:

a storage container including an electrically operable circulating pump for the storing, carbonating and cooling of water to be dispensed as desired through an opening in the storage container;

a flow-through channel for the water to be dispensed integrated into a housing of the circulator pump, said housing being mounted through a wall in the base of the storage container; and means for fastening and sealing the housing in said wall, said means further comprising a mounting flange around the pump housing for engaging the inside of said wall at regions surrounding on opening in the wall and a fastener including a coupling on the outside of the wall, said fastener surrounding the portion of the pump housing extending outside of the container and clamping the pump housing to the container wall against said flange.

7. The apparatus of claim 6 wherein said coupling comprises a bayonet coupling.

* * * * *